United States Patent [19]

Berstein

[11] Patent Number: 4,561,276

[45] Date of Patent: Dec. 31, 1985

[54] METHOD OF DEEP-ROLLING CRANKSHAFTS

[75] Inventor: Garri Berstein, Erkelenz, Fed. Rep. of Germany

[73] Assignee: Wilhelm Hegenscheidt Gesellschaft mbH, Erkelenz, Fed. Rep. of Germany

[21] Appl. No.: 568,893

[22] Filed: Jan. 9, 1984

Related U.S. Application Data

[63] Continuation-in-part of Ser. No. 305,119, Sep. 24, 1981, abandoned.

[30] Foreign Application Priority Data

Oct. 6, 1980 [DE] Fed. Rep. of Germany ..... 3037688

[51] Int. Cl.[4] ..... B21H 7/00

[52] U.S. Cl. ..... 72/81; 72/110

[58] Field of Search ..... 72/81, 107, 110, 111, 72/710; 29/6

[56] References Cited

FOREIGN PATENT DOCUMENTS

| | | | |
|---|---|---|---|
| 80819 | 5/1963 | France | 72/710 |
| 957805 | 5/1964 | United Kingdom | 72/110 |
| 622656 | 9/1978 | U.S.S.R. | 29/6 |

*Primary Examiner*—Lowell A. Larson
*Attorney, Agent, or Firm*—Arthur B. Colvin

[57] ABSTRACT

Method of deep-rolling of crankshaft pins by applying different rolling forces over a rotational angle (phi) of 360°, such as to produce in each angular position a constant enlargement of the angle (alpha) subtended by the mirror faces i.e. the faces connected with the respective transition radii to provide, at least, in the angular region most subject to damage the desired fatigue strength increase.

6 Claims, 7 Drawing Figures

FIG. 5
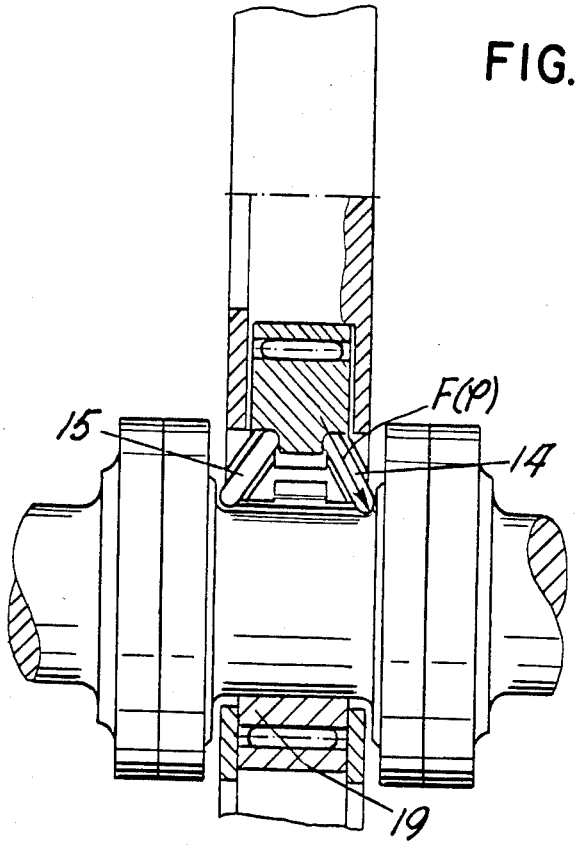
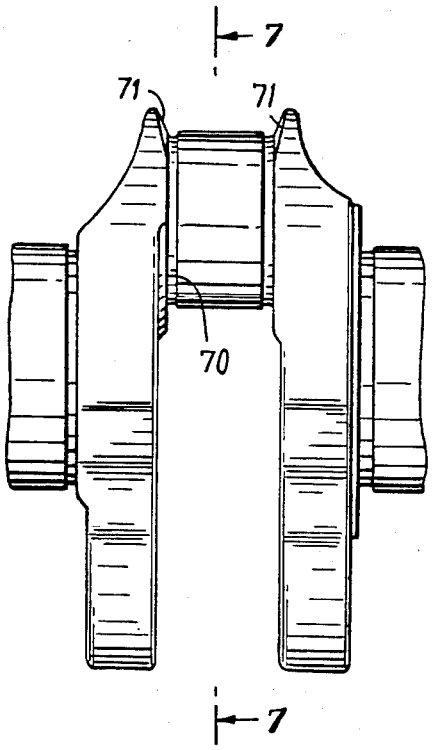
FIG. 6
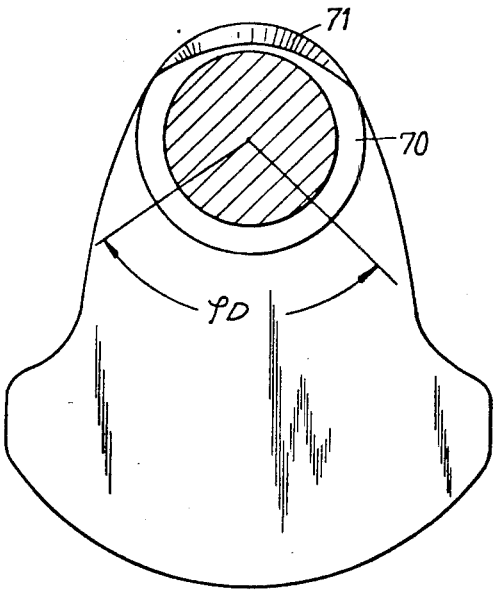
FIG. 7

METHOD OF DEEP-ROLLING CRANKSHAFTS

This application is a continuation-in-part of abandoned application Ser. No. 305,119 filed Sept. 24, 1981, which in turn takes priority from Germany application No. P 30 37 688.6 filed Oct. 6, 1980.

The invention relates to a method of deep-rolling crankshafts at fillet radii of bearing pins.

Devices by which the above named method is carried out have become known through DE-PS 1 070 955 and DE-PS 21 46 944, FIG. 1. With the cited literature references also tools suitable for the practice of the method have become known. A further development of such tools can be seen from DE-PS 26 09 787. The cited devices and tools have proved successful in the practice for carrying out the above named method.

Occasionally, however—depending on the design of the crankshaft—bends of the crank arm caused by the deep-rolling occur, which appear as a widening of the angle subtended by the faces connected with the respective transition radius. This angle enlargement differs in magnitude in circumferential direction due to the variation in circumferential direction of the crank arm, and it often exceeds at individual points the limit of reliability.

Additionally, as a result of the deep-rolling, the surfaces of the webs adjacent the ends of the crank pins, known in the trade as "mirrors" are often deflected from the desired condition in which the mirrors are precisely parallel to each other and perpendicular to the crankshaft axis, to one in which the mirrors diverge. Since the mirrors serve as lateral guides or bearing surfaces, it is obvious that departures from a precise parallel relation are highly undesireable.

Typical deep-rolling methods heretofor employed apply deep-rolling forces equally to all areas of the fillets even though it is only necessary to process a limited arc of the fillets between the crank webs which is subjected to the most stress in use. Such rolling methods result in deflection of the mirrors from the desired parallel relation, thus requiring a subsequent cutting step to re-machine the mirrors to parallel.

British Pat. No. 957,805 published May 13, 1964 discloses a two stage crankshaft rolling procedure. In accordance with this reference some of the crankshaft fillets are first rolled with a constant rolling force sufficient to reduce the tendency toward fatigue fractures. This results in bending of the crankshaft. As a second step, the remaining unrolled fillets are rolled, using rolling forces which are intended to rebend the crankshaft and counteract the bending induced by the initial rolling step. The eccentricity introduced in the crankshaft by the initial bending step is used to control the rolling forces applied in the rebending step.

The method of the British reference has many drawbacks, the most obvious of which is the time loss which inheres in performing a first rolling step and resetting the apparatus to perform the second bending step. A second drawback is that there is necessarily a time lag between the bending of the crankshaft in the first step and the straightening in the second, and the strength of the crank may be adversely affected if the second operation is not promptly performed.

It is accordingly an object of the invention to provide a one step method of deep rolling workpieces to be formed into crankshafts whereby a minimal deflection of the mirrors results from the rolling operation.

According to the invention, this problem is solved as described in the claims and in relation to a crankshaft in that, over a rotational angle phi of the workpiece of 360°, deeprolling is done with such different rolling rolling forces $F_2$ (phi) as will produce in each angular position a constant enlargement of the angle alpha subtended by the mirror faces and have at least in the angular region $phi_D$ important to the fatigue strength of the crankshaft at least the magnitude $F_{Dmin}$ necessary for the desired fatigue strength increase. Hence deep-rolling is done in a single step with different rolling forces as a function of the angle of rotation of the workpiece. These rolling forces should be the greater as the deformation resistance of the workpiece against said angle enlargement is greater at the respective rolling point. Thereby a uniform angle enlargement between the mirrors is achieved throughout the 360° rotation of the shaft with the result that the mirrors remain parallel after rolling is completed. One must watch, however, that at least in the angle positions wherein the fatigue strength of the crankshaft is critical that the rolling force has at least the magnitude necessary for the desired fatigue strength increase. The noted method results in a fatigue strength increase in an order of magnitude already known in the state of the art and yet, minimal deflection of the mirrors results when considering the magnitude of the rolling forces required to be applied.

In further development of the invention, it is proposed that the rolling forces $F_2$ (phi) pulsate at a frequency of 30 to 300 Hz and an amplitude of 5 to 50% of their instantaneous nominal value, with the lowest points of the tool impressions originating from the maximum value, insofar as they would result under static load, succeeding each other at a distance not greater than double the impression width itself. The superposition of the base rolling force on a pulsating rolling force of the stated frequency and amplitude causes, as compared with the effect of said base rolling force, an increase in the depth of hardness and micro-hardness and hence a further increase of the fatigue strength. Conversely, when the fatigue strength objective has already been reached, one can operate with smaller forces and hence with smaller angle enlargements.

Again according to a development of the invention it is proposed that the minimum value $F_2$ of the rolling forces $F_2$ (phi) corresponds to the value for attaining a desired smooth rolling result. By the measure indicated thereby it is achieved that in addition to the desired fatigue strength increase at the same time a hope-for smooth rolling result, that is, a workpiece surface of desired smoothness, is obtained.

According to another development of the invention, it is proposed that deep-rolling is done first by a static method and then by a pulsating method. This means that the method according to the invention is broken down into its own main components, which are carried out independently of each other. This permits testing the results of the individual steps and moreover allows using separately working different tools, so that the tools can be simplified.

Central to the method of the present invention is the recognition that a desired relation of the mirrors of a crankshaft can be maintained by applying in the first instance rolling forces against the workpiece which vary in such manner as to result in essentially equal deflection of the mirrors from the desired parallel relation throughout rotation of the crankshaft.

In accordance with an embodiment of the invention, the workpiece may be so formed that the mirrors are not precisely parallel in the first instance. By the application of variable rolling forces, the initial rolling operation results in a deflection of the workpiece such that the mirrors are brought into the desired parallel relation.

The invention will now be explained in greater detail with reference to the attached drawings, in which:

FIG. 1 shows a deep-rolling device in section I—I per FIG. 3, with control digram for the hydraulic control;

FIG. 2 a deep-rolling device in section I—I per FIG. 3, with another embodiment of the control diagram for the hydraulic control;

FIG. 3 deep-rolling devices in top view;

FIG. 5 is a magnified section taken on line II—II of FIG. 1.

FIG. 6 is a schematic fragmentary elevational view of a crankshaft workpiece depicting the type of distortion or deflection of the mirrors resulting from the application of deep rolling forces.

FIG. 7 is a section taken on line 7—7 of FIG. 6.

Figure 1:
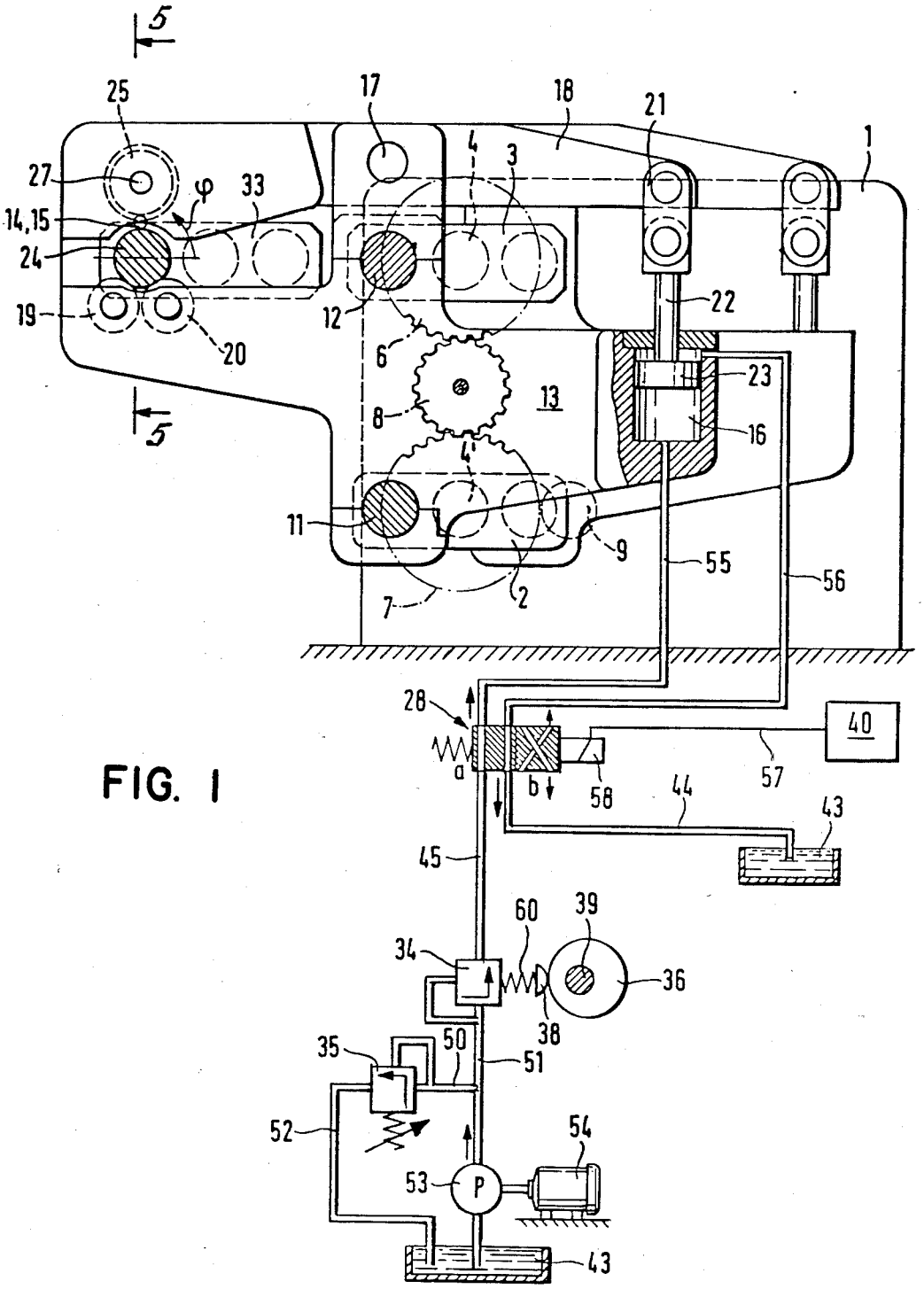
Figure 3:
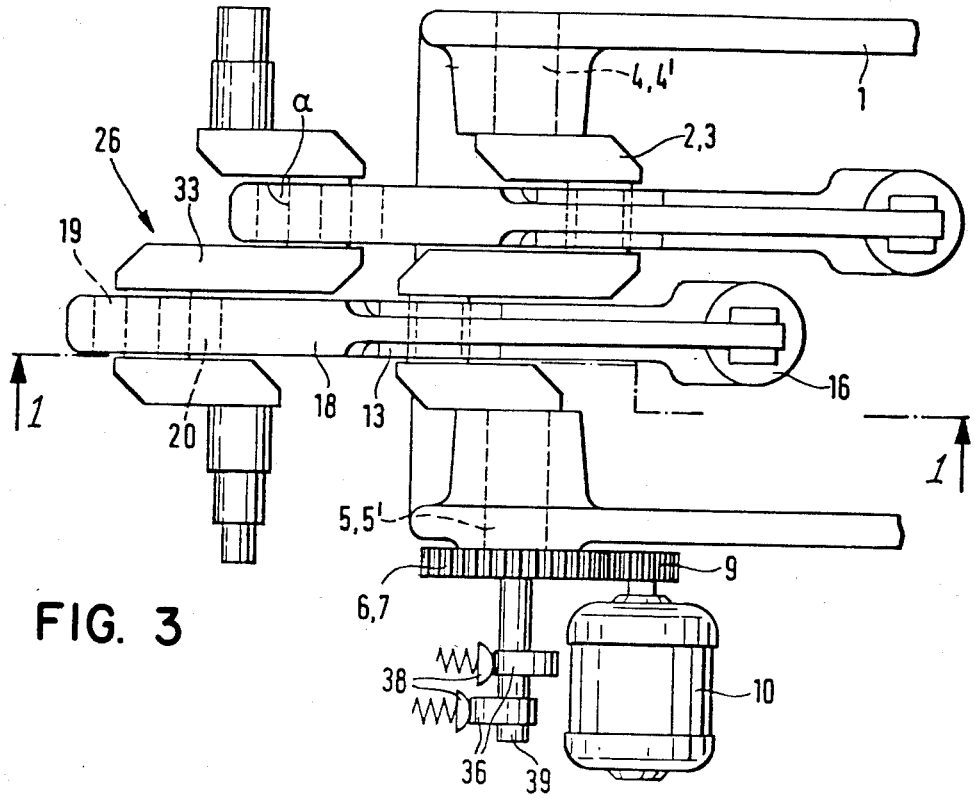

In frame 1, FIGS. 1 and 3, two identical crankshafts are mounted as so-called master shafts 2 and 3 in the bearing points 4, 4' and 5, 5'. Each of the two master shafts 2 and 3 carries on the drive side a gear 6 and 7 of equal size, which mesh with a gear 8 mounted in frame 1. Gear 7 received its drive from the pinion 9 on the shaft of a motor 10.

On each of the crank pins 11 and 12 of the master shafts 2 and 3 is mounted a two-sided lever 13, on whose one side are fastened the cylindrical supporting rollers 19 and 20 and on its other side the hydraulic cylinder 16. At the same time there is mounted on pin 17 of each two-sided lever 13 a two-sided lever 18, which carries on one side the compacting rollers 14 and 15 for the fillets, and on the other side, by way of a joint 21, the piston rod 22 and piston 23, which slides in the cylinder 16.

The axis of rotation of each compacting roller 14 and 15 subtends with the workpiece axis an angle of for example 45°. The deep-rolling rollers 14 and 15 take support on the one hand in the fillets of the crank pin 24, and on the other hand in the grooves of a race 25 for each, which races are mounted on bolts 27 by way of rolling bearings in the two-sided lever 18.

In the embodiment according to FIG. 1, cylinder 16 is connected with lines 55,56 which in turn are connected through a directional control valve 28, on the one hand via a line 44 with the tank 43, and on the other hand, via a line 45 and a pressure regulating valve 34 lying in this line via a further line 51, with a pump 53 which is driven by a motor 54. This hydraulic system is secured against undesired pressure excess via a line 50, via a pressure limiting valve 35 and a line 52 connecting the pressure limiting valve 35 with tank 43.

The switching magnet 58 of the directional control valve 28 is connected with the machine control 40 via a control line 57. The pressure adjustment of the pressure regulating valve 34 is effected through a spring 60 which has at its end a ram 38 applying against a cam plate 36. Cam plate 36 is carried and driven by a shaft 39 which is driven by the master shaft 3 on the side of the bearing point 5.

Figure 2:
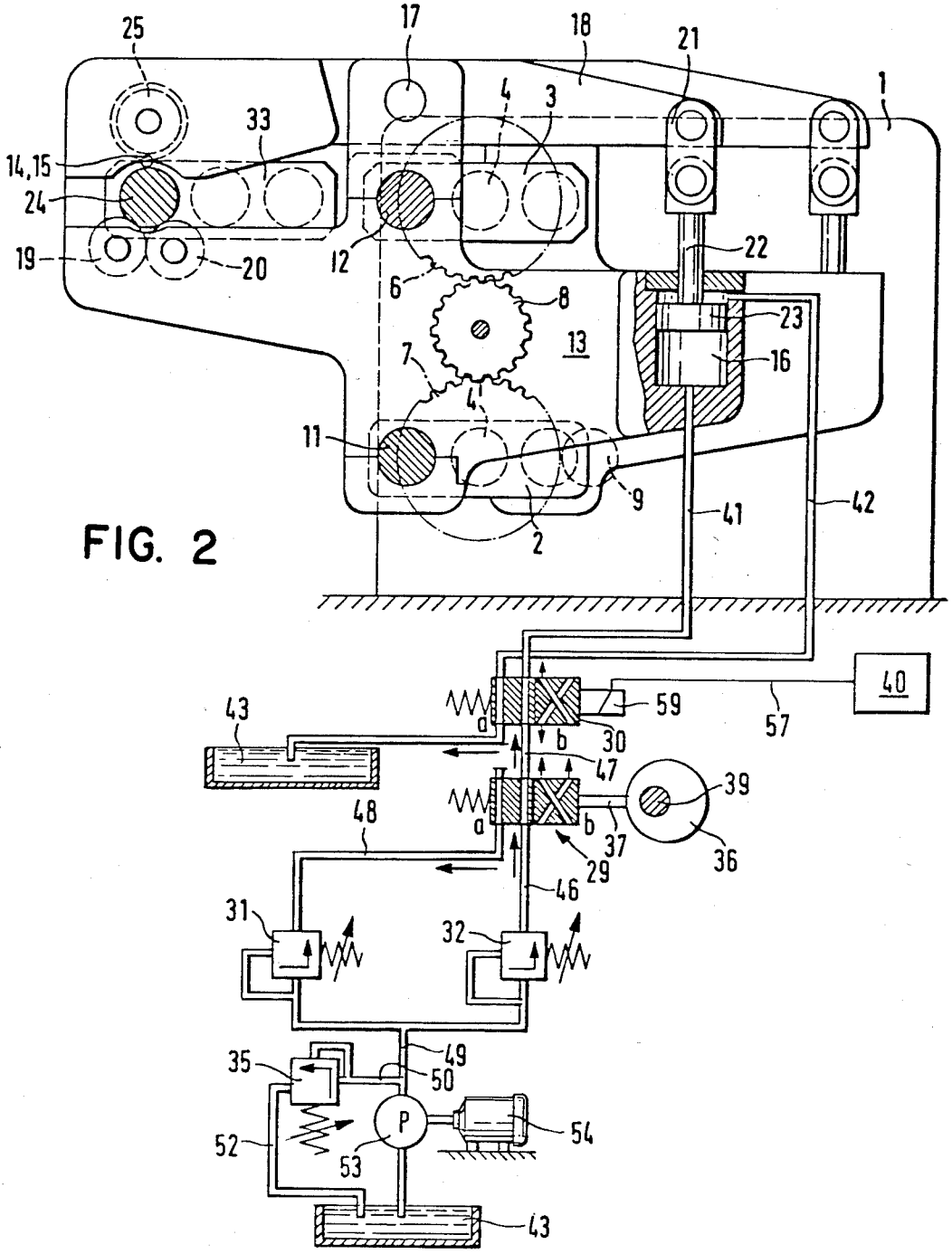

Also in the embodiment according to FIG. 2, shaft 39 with cam plate 36 is present in the same arrangement.

In the embodiment according to FIG. 2, cylinder 16 is connected via the lines 41 and 42 with a directional control valve 30, which can connect the lines 41 and 42 selectively with tank 43 or via line 47 with a further directional control valve 29. The two inputs of this directional control valve 29 are connected via the lines 48, 46 with the pressure regulating valves 31,32, which in turn are connected via the manifold 49 with the pump 53 driven by motor 54. Here again the pump 53 is connected with tank 43 via line 50 and pressure regulating valve 35 and further via line 52.

In the embodiment according to FIG. 2, the directional control valve 29 is actuated by a ram 37 which applies against the cam plate 36 driven by shaft 39.

The switching magnet 59 of the directional control valve 30 is again connected with the machine control 40 via the control line 57. For greater simplicity here only the control of one hydraulic cylinder 16 is described. An equivalent control must exist for each cylinder 16 present in the machine. This is to be indicated by the two camplates 36 shown in FIG. 3, against which applies each time an associated ram 38.

FIG. 5 shows a section according to lines II—II in FIG. 1.

According to this constructional example two fillets can be rolled simultaneously by rollers 14 and 15 with a rolling pressure F which alters itself in accordance to the angle of rotation. The supporting roller 19 merely supports the workpiece.

The device operates as follows:

The crankshaft 26 (FIG. 3) is placed freely on the rollers 19 and 20 in lever 13, in such a way that each crank pin of crankshaft 26 lies parallel to the crank pin of the master shafts 2 and 3. Now the piston 23 is pressurized by pressure oil on its underside. This is effected in the embodiment according to FIG. 1 in that, with pump 53 running, the machine control 40 via control line 57 causes the switching magnet 58 to trip, so that the directional control valve 28 moves into switching position a. In this position the pressure oil can pressure the underside of piston 23 from the pump via line 51 through the pressure regulating valve 34 and line 45 via directional control valve 28 and line 55. The cylinder space above piston 23 of cylinder 16 is connected with tank 43 via lines 56 and 44 via directional control valve 28. The compacting rollers 14 and 15 therefor move toward the crank pin 24 to be machined and are held in operating position with a force which is a function of the hydraulic pressure present on the underside of piston 23 in cylinder 16. This hydraulic pressure is regulated by the pressure regulating valve 34, which is changed in its adjustment by the cam plate 36 via spring 60 and ram 38. The force with which the compacting rollers 14 and 15 apply against the crank pin 24 to be machined depends, therefore, on the rotational position of the cam plate 36. The cam plate 36 always occupies the same angular position relative to the master shafts 2 and 3. Also the crankshaft 26 to be rolled always occupies the same rotational position relative to the master shafts 2 and 3. Thus a certain hydraulic pressure controlled by cam plate 36 is always correlated with a certain rotational position of crankshaft 26.

For safe functioning of the system it is necessary that the desired maximum pressure with which the hydraulic cylinder 16 is to be supplied is always lower than the maximum system pressure limiting valve 35.

To pressurize the piston 23 on its underside with pressure oil in the embodiment according to FIG. 2, the machine control 40 causes via control line 57 tripping of the switching magnet 59 of the directional control valve 30, so that the valve switches to position a. Thereby line 42 is connected with tank 43, and line 41 is connected via valve 30 and line 47 with the directional control valve 29. In the starting position here described, the cam plate disposed on shaft 39 is to be set so that ram 37 of valve 29 applying against the cam plate 36 switches valve 29 to position a. Thereby, via pump 53 driven by motor 54, the pressure oil can get via line 9 through the pressure regulating valve 32 and line 46 via the directional control valve 29 to line 47 and hence via directional control valve 30 to the line 41 connected with cylinder 16. The compacting rollers 14 and 15 now apply against the crank pin 24 to be machined with a force which corresponds to the hydraulic pressure in cylinder 16. This pressure, in turn, is determined in the described switching position by the adjustment of the pressure regulating valve 32.

After the compacting rollers 14 and 15 in either embodiment apply force against the crank pin 24 to be machined, motor 10 is turned on. The drive force of motor 10 acts via pinion 9 and gears 7, 6, 8 on both master shafts 2 and 3, which bring the two-sided levers 13 and 18 into a circular movement and at the same time also drive shaft 39 with the cam plates 36 at equal angular velocity.

In the embodiment according to FIG. 1, by the rotary movement of the master shafts 2 and 3 the cam plate 36 is rotated and causes via ram 38 and spring 60 a corresponding change of the pressure adjustment of the pressure regulating valve 34. In this simple manner the deep-rolling force of the deep-rolling roller 14, 15 can be carried as a function of the angular position of crankshaft 26, the magnitude of the change being determined by the form of the cam plate.

In especially simple cases it suffices to choose, over an angle of rotation of 360° of the crankshaft 26, between two different, suitable deep-rolling forces. This can be achieved also by a circuit arrangement according to the embodiment of FIG. 2. Here, during the rotational movement of cam plate 36, the directional control valve 29 is switched by cam plate 36 via ram 37 from the initial position a to position 1a whereby the underside of piston 23 is pressurized by a hydraulic pressure which corresponds to the pressure adjustment at the pressure regulating valve 31.

When the deep-rolling operation is completed, motor 10 is turned off. After stoppage of motor 10, the compacting rollers 14 and 15 must now be lifted off the crankshaft 26 again, so that the latter can be taken out of the machine. The lifting off of the deep-rolling rollers 14 and 15 from the workpiece is done in the embodiment of FIG. 1 in that the switching magnet 58 is actuated by the machine control 40 via the control line 58, whereby the directional control valve 28 is switched to position b. In this position line 55 is connected with tank 43 and line 56 with the pressure line 45. Thereby piston 23 moves into cylinder 16 and thus causes via the two-sided lever 18 the desired movement of the deep-rolling rollers 14 and 15.

The procedure is similar also in a device according to the embodiment per FIG. 2. Here, via the machine control 40 and control line 57, the switching magnet 59 is actuated and thereby the directional control valve 30 is switched to position b. In this position line 42 is connected with the pressure line 41 with tank 43. Thereby piston 23 enters into cylinder 16 and thus causes the desired movement of the compacting rollers 14 and 15 again via the two-sided lever 18.

Figure 4:
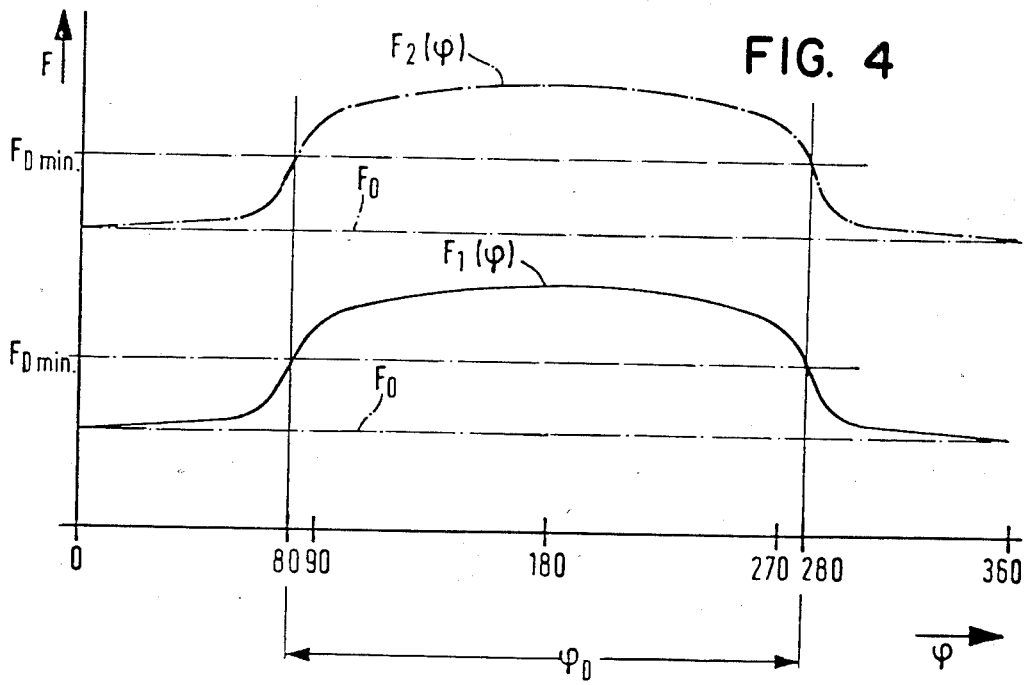
FIG. 4 is a graph representing the deep-rolling force curve as a function of the angle of rotation phi of the workpiece.

FIG. 4 shows an example of a diagram of the rolling pressures $F_1$ and $F_2$ in relation to the angle of rotation which is an angle of 360°.

The crankshaft is liable to fatigue fracture in the area of angle $\phi_D$ as in the described example. For this reason this region is rolled with increased rolling strength $F_{Dmin}$.

Two parallel gliding planes are shown, with which is indicated that from workpiece to workpiece various increased in fatigue strength can be achieved. Due to this, the absolute value alters with $F_{Dmin}$. The characteristics of the rolling pressure in relation to the angle of rotation phi however remains unchanged with the same workpiece shape.

It could be of great advantage if this rolling pressure, e.g. $F_2$ (phi) is pulsated with a certain frequency, i.e. a frequency of from about 30 to 300 Hz the pulsating forces operating at an amplitude of from about 5 to 50% of the instantaneous nominal value of the rolling forces, with the lowest points of the tool impressions originating from the maximum value insofar as they would result under static load, succeeding each other at a distance not greater than double the impression width itself.

If the force function F (phi) of the rolling force is now known, it can be determined for example as follows.

A crankshaft of a series to be rolled is inserted into the rolling device in the manner already described and is rolled with a constant force $F_0$, which corresponds to about $\frac{1}{3}$ of $F_{Dmin}$-that is, the minimum rolling force for attaining the desired fatigue strength. Then the crankshaft is taken out and the course and size of the described angle enlargements are measured. Thereafter, by appropriate machine adjustment (cam plate, pressure regulating valves) rolling is done with a force $F_1$ (phi) which in its course over the angle of rotation phi is approximately proportional to the ratio of greatest angle enlargement to local angle enlargement. Since the region of smallest angle enlargement is invariably also where the fatigue rupture endangered angle region $phi_D$ lies, one must roll in this region at least with the force $F_{Dmin}$ necessary for the desired fatigue strength increase. To achieve this, by changing the base adjustment of the pressure regulating valves 34 or respectively 31 and 32, the force $F_1$ (phi) is shifted parallelly (see FIG. 4) until in the starting point of angle $phi_D$ the force $F_{Dmin}$ is reached. The crankshaft is then rolled with the force $F_2$ (phi). All crankshafts of this series can now be rolled with this adjustment.

In a deep-rolling operation with a compact rolling force remaining constant over 360°, the angle formed by crank arm 33 and crank pin 24 is widened in different degree in different angular positions. By the proposed measures an angle enlargement uniform in circumferential direction is achieved and at the same time this angle enlargement can e maintained relatively small. Since a uniform angle enlargement is achieved, it can be taken into consideration for the crankshafts during preliminary machining. The described method is not restricted only for use on crankshafts, but can be applied to any workpiece having fillets which are eccentric relative to the axis of rotation of the workpiece.

FIGS. 6 and 7 are schematic views on an exaggerated scale depicting the distortion of the mirrors 70 resulting from the typical practice of applying equal rolling forces throughout the entire rotation of the workpiece. As will be seen from these figures, due to the geometry of the crankshaft, the deflection is greatest in the areas 71,71. In FIG. 7, the angle $\phi_D$ represents the area most in need of the fatigue resisting improvements resulting from rolling.

A significant advantage of the described rolling process is that the crank webs and particularly the mirrors need not be remachined after rolling. This is in contrast to conventional rolling procedures wherein, after rolling, the crankshaft must be re-cut to restore the desired parallel condition of the mirrors.

From the foregoing description it will be apparent that there is disclosed in accordance with the present application a method of deep-rolling a workpiece for a crankshaft wherein the mirrors are retained in a desired parallel condition without the necessity of an additional cutting step following rolling. The method moreover, contemplates forming a cam which accurately controls the variable rolling forces to be applied to a crankshaft of a particular geometry by first rolling the crankshaft with constant forces and thereafter forming the cam in accordance with distortions observed in the crankshaft.

As will be apparent to a skilled worker in the art familiarized with the instant disclosure numerous variations may be introduced in the described method without departing from the spirit of the invention. Accordingly the invention is to be broadly construed within the scope of the appended claims.

Having thus described the invention and illustrated its use, what is claimed as new and desired to be secured by Letters Patent in the United States is:

1. The method of deep rolling the fillets of a workpiece having bearing pins parallel to the axis of rotation, said bearing pins being bounded at at least one end by a lateral surface, each of said fillets forming a transition radius between the said lateral surface and the surface of a related bearing pin, comprising the steps of rotating said workpiece about its axis while simultaneously continuously applying to the said fillets a rolling force of varying magnitude, the magnitude of said rolling force being maintained at a value to cause said lateral surfaces of said bearing pins to assume a constant angle of enlargement relative to the axis of said pins throughout an entire rotation of said workpiece, said rolling force being at least of the magnitude necessary to produce a desired fatigue strength increase in selected arcuate areas of said workpiece.

2. The method in accordance with claim 1 wherein the minimum value of the rolling force applied is at all times sufficient to achieve a smooth rolling result.

3. The method in accordance with claim 1 wherein said rolling force pulsates at a frequency of from about 30 to 300 Hz and at an amplituted of from about 5 to 50% of the instantaneous average value of the rolling force.

4. The method of claim 1 and including the step of providing a radial cam having a profile coordinated with the rolling force necessary to achieve said constant angle of enlargement, rotating said cam in synchronized relation to said workpiece, and varying the rolling force applied to said workpiece as a function of the rotated position of said cam.

5. The method of claim 4 and including the step of forming said radial cam by first rolling a said workpiece with a constant high rolling force to thereby induce a permanent angle of enlargement of said lateral surfaces relative to the axis of said pins, and thereafter forming the profile of said cam as a function of the degree of enlargement of said lateral surfaces.

6. The method of deep rolling the fillets of a workpiece, to be formed into a crankshaft having bearing pins parallel to and offset from the axis of said crankshaft, said bearing pins being bounded at opposite ends by mirror surfaces substantially perpendicular to the axis of the crankshaft comprising the steps of rotating said crankshaft about its axis while simultaneously continuously applying to the said fillets a rolling force of varying magnitude, the magnitude of said rolling force being continuously maintained at a value to cause said mirror surfaces to opposite sides of said bearing pins to assume a constant angle of enlargement relative to the axis of said bearing pins throughout an entire rotation of said workpiece, said rolling force being at least of the magnitude necessary to produce a desired fatigue strength increase in selected arcuate areas of said workpiece.

* * * * *